US007965269B2

(12) United States Patent
Shikina

(10) Patent No.: US 7,965,269 B2
(45) Date of Patent: Jun. 21, 2011

(54) ACTIVE MATRIX TYPE DISPLAY APPARATUS

(75) Inventor: Noriyuki Shikina, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 928 days.

(21) Appl. No.: 11/755,938

(22) Filed: May 31, 2007

(65) Prior Publication Data

US 2008/0042937 A1 Feb. 21, 2008

(30) Foreign Application Priority Data

Jun. 30, 2006 (JP) ..... 2006-181671

(51) Int. Cl.
*G09G 3/36* (2006.01)

(52) U.S. Cl. ..... 345/87; 345/100; 345/102

(58) Field of Classification Search ..... 345/63, 345/76, 77, 82, 87, 100, 102, 158, 173, 179, 345/211–214, 596, 690; 349/86, 88; 348/756; 315/169.3

See application file for complete search history.

(56) References Cited

U.S. PATENT DOCUMENTS

| | | | | |
|---|---|---|---|---|
| 6,373,454 | B1 * | 4/2002 | Knapp et al. | 345/76 |
| 6,653,793 | B1 * | 11/2003 | Itokawa et al. | 315/169.1 |
| 6,841,948 | B2 | 1/2005 | Yoshida | 315/169.3 |
| 6,867,761 | B2 * | 3/2005 | Matsueda | 345/100 |
| 6,868,359 | B2 * | 3/2005 | Raab | 702/150 |
| 7,518,593 | B2 * | 4/2009 | Daiku | 345/102 |
| 2004/0017355 | A1 * | 1/2004 | Shim | 345/157 |
| 2004/0056605 | A1 | 3/2004 | Yoshida | 315/169.3 |
| 2005/0280616 | A1 * | 12/2005 | Miwa et al. | 345/77 |
| 2006/0232521 | A1 * | 10/2006 | Jang et al. | 345/76 |
| 2006/0256043 | A1 * | 11/2006 | Hagihara et al. | 345/67 |
| 2008/0238909 | A1 * | 10/2008 | Yamashita et al. | 345/211 |
| 2009/0184984 | A1 * | 7/2009 | Takahara | 345/690 |

FOREIGN PATENT DOCUMENTS

| | | |
|---|---|---|
| JP | 6-282241 | 10/1994 |
| JP | 2004-117648 | 4/2004 |

* cited by examiner

*Primary Examiner* — Prabodh M Dharia
(74) *Attorney, Agent, or Firm* — Fitzpatrick, Cella, Harper & Scinto

(57) ABSTRACT

A display apparatus including pixel circuits arranged in the row and column direction to form a display portion, the pixel circuit including a capacitor which holds an electric signal representing information, a driving transistor, a control terminal of which is connected to one end of the capacitor and which outputs driving current according to information held in the capacitor, a light emitting element which emits light with brightness according to current output from the driving transistor, and a switching element which opens and closes a current path from the driving transistor to the light emitting element, wherein a time period during which the switching element closes the current path is set to be the longest in the pixel circuit at the center of the display portion and to be gradually shorter according to the distance to the end side of the display portion.

6 Claims, 12 Drawing Sheets

ACTIVE MATRIX TYPE DISPLAY APPARATUS

BACKGROUND OF THE INVENTION

1. Field of the Invention

The present invention relates to an active matrix type display apparatus which emits light in accordance with an electric current, and in particular, to an active matrix display apparatus using an EL element or the like.

2. Description of the Related Art

In recent years, in a flat display apparatus formed of an electroluminescence (EL) element, it is general that pixels arranged in a matrix form are driven through scanning lines and data lines.

Specifically, pixels are commonly connected to a scanning line on a row basis and to a data line on a column basis. A row scanning circuit selects each of the scanning lines and at the same time a column scanning circuit applies a predetermined display signal to each of the data lines to cause the pixel of the selected row to perform a predetermined display.

An EL display device based on active matrix driving is disclosed in U.S. Pat. No. 6,373,454.

In the display apparatus formed with the EL elements, controlling a current flowing into the EL element enables adjusting the light emitting intensity of each pixel.

FIG. 15 illustrates the schematic diagram of an active matrix type display apparatus. The display apparatus includes a current setting circuit 101, scanning line drive circuit 102 and pixel circuit 103.

FIG. 16 is an example of a pixel circuit including an EL element. Reference characters P1 and P2 denote scanning signal lines and current data "Idata" is input as information signal.

The anode of the EL element is connected to the drain terminal of a TFT (M4) and the cathode thereof is connected to a ground potential CGND.

The pixel circuit further includes p-type TFTs M1, M2 and M4 and an n-type TFT M3. The following briefly describes how the pixel circuit operates.

When the information signal Idata is input, a HI level signal is input into the scanning signal line P1 and a LOW level signal is input into the scanning signal line P2. The transistors M2 and M3 are turned on and the transistor M4 is turned off.

At this point, the transistor M4 is not in a conductive state, which causes a current not to flow into the EL element.

The current data Idata develops a voltage according to the current driving capability of the transistor M1 across a capacitor C1 arranged between the gate terminal of the transistor M1 and the power source potential V1.

When a current needs to be supplied to the EL element, a LOW level signal is input into the scanning signal line P1 and a HI level signal into the scanning signal line P2.

At this point, the transistor M4 is turned on and the transistors M2 and M3 are turned off.

Since the transistor M4 is in a conductive state, a voltage developed across the capacitor C1 supplies the EL element with a current according to the current driving capability of the transistor M1. This causes the EL element to emit light with brightness according to the supplied current.

The above active matrix type EL display apparatus has an unsolved problem that a display on a screen is brightened without increase in consumption power.

As a means of solving the problem, a method is devised of suppressing brightness around the periphery of a screen and increasing it at the central portion thereof. This method exercises a slight influence on display quality.

A related art is disclosed in Japanese Patent Application Laid-Open No. 06-282241, in which the above problem is solved by using a plasma display.

The above art, however, is inapplicable to the active matrix type display apparatus.

Another method is considered in which image data is processed using a lookup table.

In this case, however, a system load is generated when image data is processed and a dynamic range of a data driver needs to be increased.

SUMMARY OF THE INVENTION

It is an aspect of the invention to provide an active matrix type display apparatus capable of suppressing a system load, maintaining the dynamic range of the data driver and providing a bright display on a screen without increase in consumption power.

The present invention provides an active matrix type display apparatus including pixel circuits arranged in the row and column directions to form a display portion, the pixel circuit including a capacitor which holds an electric signal representing information, a driving transistor, a control terminal of which is connected to one end of the capacitor and which outputs driving current according to information held in the capacitor, a light emitting element which emits light with brightness according to current output from the driving transistor, and a switching element which opens and closes a current path from the driving transistor to the light emitting element, wherein a time period during which the switching element closes the current path is set to be the longest in the pixel circuit at the center of the display portion and to be gradually shortened according to the distance to the end side of the display portion.

According to one aspect of the present invention, the switching elements of the pixel circuits may be connected to a common control signal line common in the row or the column direction so as to be opened and closed simultaneously.

According to another aspect of the present invention, the switching element may be connected between the driving transistor and the light emitting element and connected to a common control signal line in the row direction and controlled so that the conductive period of the switching elements of the pixel circuits in the central row is longer than the conductive period of the switching elements of the pixel circuits in the upper and the lower side rows.

According to the present invention, the display apparatus is capable of suppressing a system load and decreasing brightness from the central portion to the peripheral portion of the screen without losing the dynamic range of the data driver. This effect enables consumption power to be decreased with apparent brightness maintained.

Further features of the present invention will become apparent from the following description of exemplary embodiments with reference to the attached drawings.

DESCRIPTION OF THE EMBODIMENTS

Exemplary embodiments for carrying out the present invention are described below with reference to the attached drawings.

First Embodiment

Figure 1:
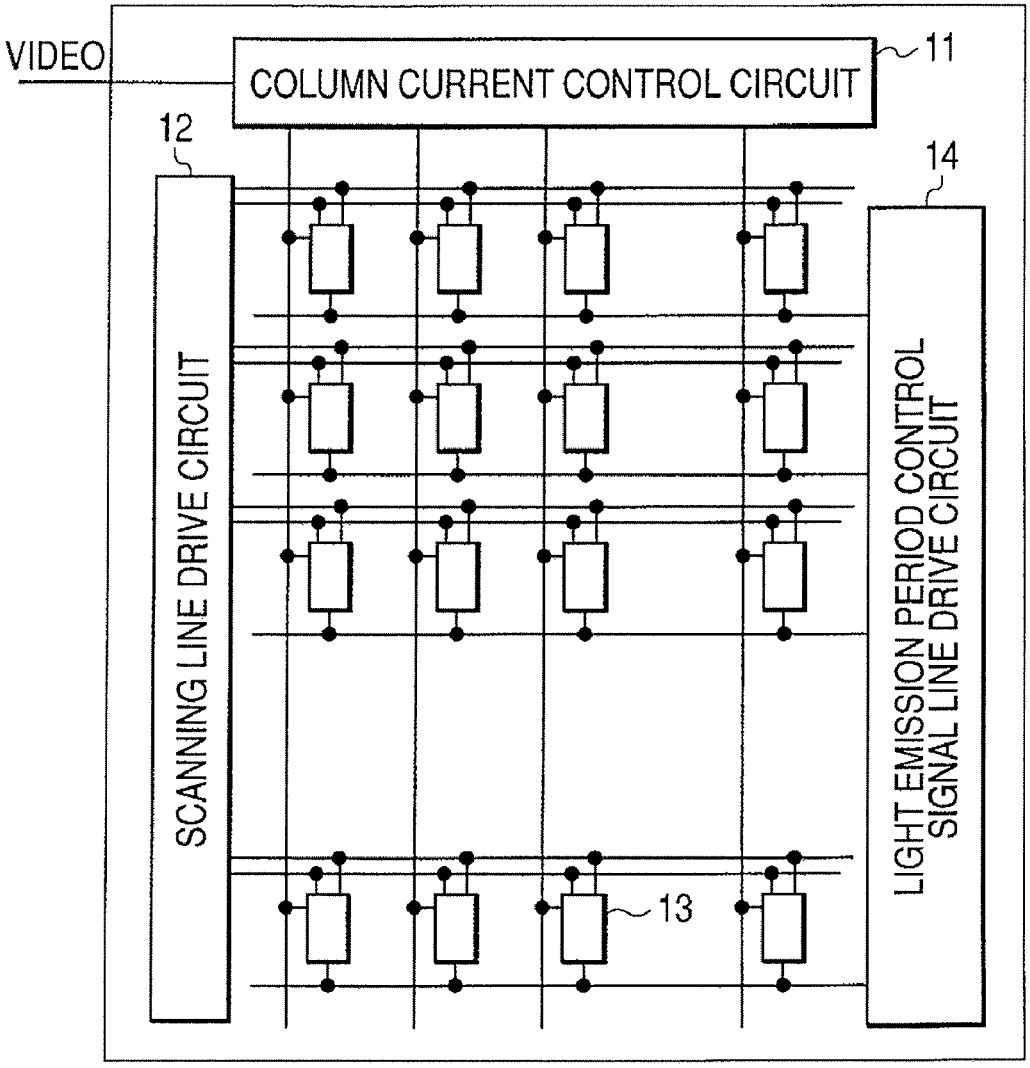
FIG. 1 is a block diagram illustrating the configuration of a first embodiment of the present invention.

FIG. 1 is a block diagram illustrating the configuration of the display apparatus in the first embodiment of the present invention.

The display apparatus of the present embodiment includes a column current control circuit 11, scanning line drive circuit 12, pixel circuit 13 and light emission period control signal line drive circuit 14.

The column current control circuit 11 serves to output a control current "Idata" to an information line.

The light emission period control signal line drive circuit 14 serves to control a light emission period through the light emission period control signal line and functions as a control unit (control circuit).

Figure 2:
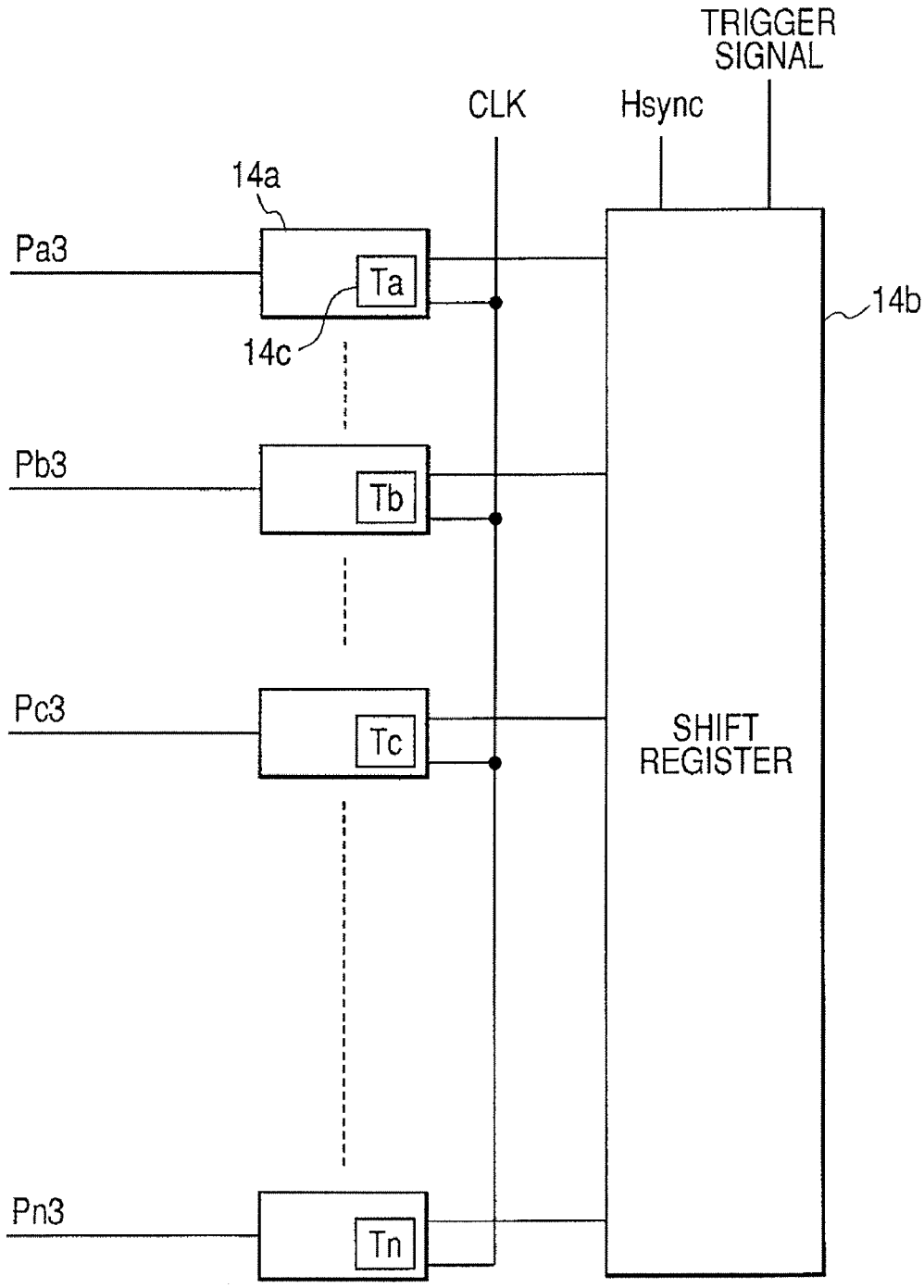
FIG. 2 is an enlarged block diagram illustrating a part of a circuit configuration of the first embodiment.

FIG. 2 is an enlarged block diagram illustrating the configuration of the light emission period control signal line drive circuit 14.

As illustrated in FIG. 2, a timer circuit 14*a* is provided on the light emission period control signal line. The timer circuit 14*a* is provided with a hold time holding circuit 14*c*.

A signal output from the light emission period control signal line drive circuit 14 is input into the timer circuit 14*a*. The output timing and the output time period are determined in accordance with time held in the hold-time holding circuit 14*c*.

The output timing and the output time period which the hold-time holding circuit 14*c* holds therein is determined based on a clock signal to be input.

Figure 3:
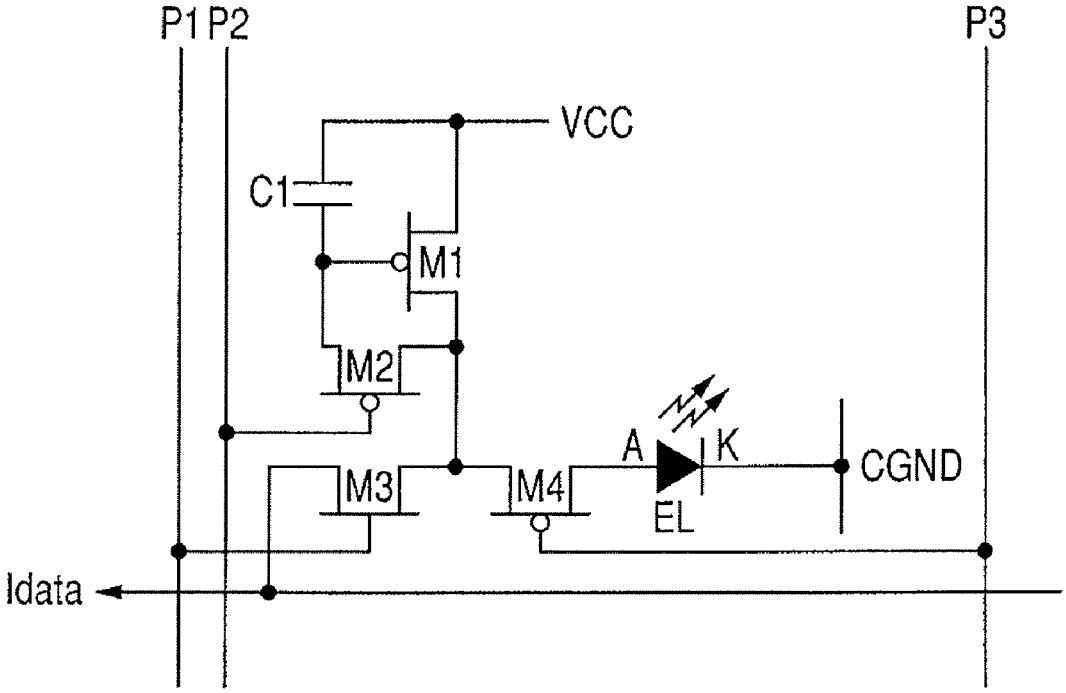
FIG. 3 is a pixel circuit diagram of the first embodiment.

FIG. 3 is a circuit diagram as an example of configuration of a pixel circuit including a light emitting element of the present embodiment.

The pixel circuit includes scanning signal lines P1 and P2 and a light emission period control signal line P3.

The anode of an EL element being the light emitting element is connected to the drain terminal of a TFT (M4) and the cathode thereof is connected to a ground potential CGND. The pixel circuit further includes p-type TFTs M1, M2 and M4 and an n-type TFT M3. The transistor M1 is a driving transistor for supplying the EL element with driving current for emitting light and the transistor M4 is a switching element.

The following briefly describes how the pixel circuit operates.

When the information signal Idata is input, a HI level signal is input into the scanning signal line P1, a LOW level signal is input into the scanning signal line P2 and a HI level signal is input into the scanning signal line P3. The transistors M2 and M3 are turned on and the transistor M4 is turned off.

At this point, the transistor M4 is in a non-conductive state, which causes a current not to flow into the EL element. The current data Idata develops a voltage according to the current driving capability of the transistor M1 across a capacitor C1 arranged between the gate terminal of the transistor M1 and the power source potential V1 and this voltage is held in the capacitor C1.

When a current needs to be supplied to the EL element, a LOW level signal is input into the scanning signal line P1, a HI level signal into the scanning signal line P2 and a LOW level signal into the scanning signal line P3.

At this point, the transistor M4 is turned on and the transistors M2 and M3 are turned off. Since the transistor M4 is in a conductive state, a voltage developed across the capacitor C1 provides the EL element with a current according to the current driving capability of the transistor M1. This causes the EL element to emit light with brightness according to the supplied current.

When a current flowing into the EL element needs to be cut off, a LOW level signal is input into the scanning signal line P1 and a HI level signal into the scanning signal lines P2 and P3.

At this point, the transistors M4, M2 and M3 are turned off.

The transistor M4 in a non-conductive state cuts off current supplied to the EL element and causes the EL element to be in a non-light emitting state.

Thus, changing over a level signal from HI to LOW or vice versa on the scanning signal line P3 allows arbitrarily controlling a light emitting period.

In the present embodiment, the configuration in FIG. 3 is cited as an example of a pixel circuit, however, it is not limited to this example.

Although a current programming type pixel circuit is cited as an example, a voltage programming type pixel circuit may also be used. The configuration in FIG. 2 disclosed in Japanese Patent Application Laid-Open No. 2004-117648 is cited as an example of the voltage programming type pixel circuit.

The operation of the entire display apparatus is hereinbelow described.

Figure 4:
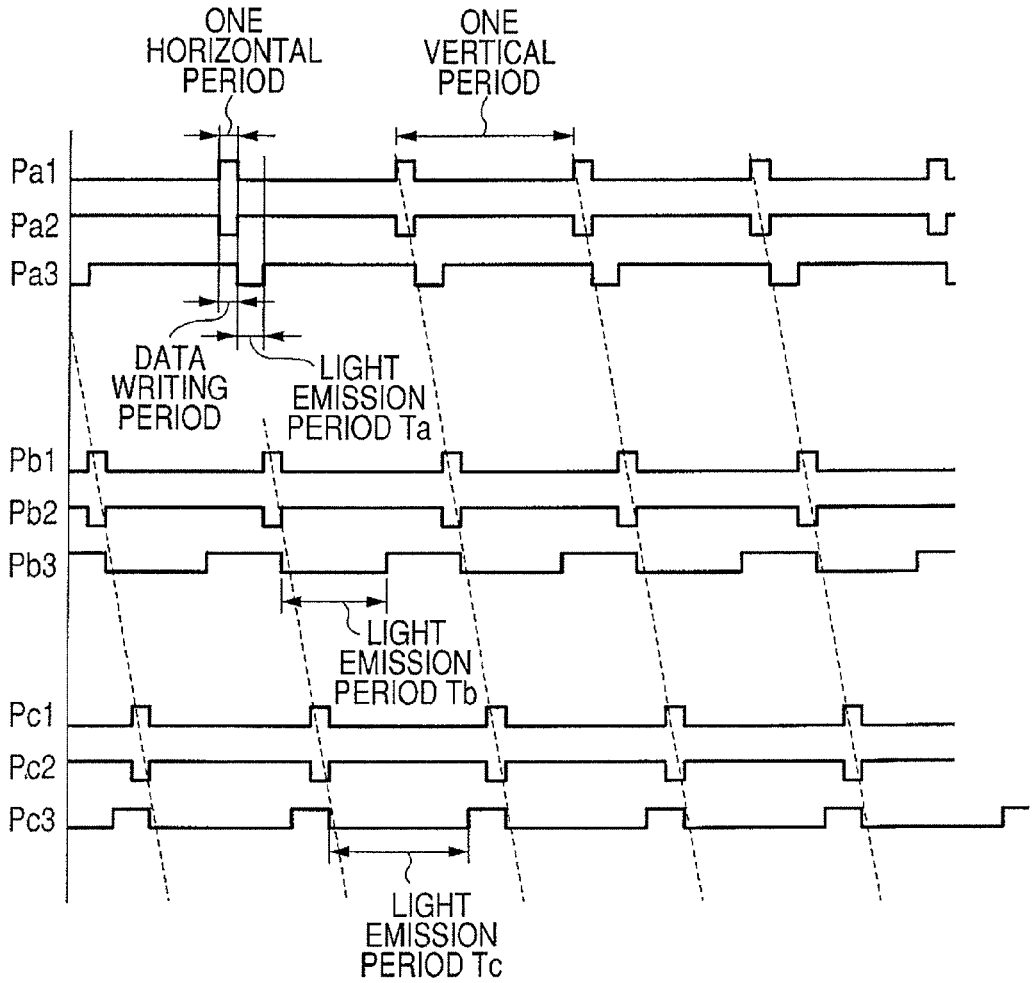
FIG. 4 is a timing chart illustrating the operation of the first embodiment.

FIG. 4 is a timing chart of each signal line.

In the present panel, information current is collectively written into a pixel group connected to one scanning line during one horizontal (scanning) period.

Similarly, information current is sequentially and collectively written into a pixel group connected to a scanning line in the next row. Thus, writing information current into all pixels is finished during one vertical (scanning) period.

Where, the scanning signal lines P1 and P2 connected to pixel circuits in the upper end row of the panel are taken to be Pa1 and Pa2 respectively and the light emission period control signal line is taken to be Pa3.

The scanning signal lines P1 and P2 connected to pixel circuits between the upper end row and the central row of the panel are taken to be Pb1 and Pb2 respectively and the light emission period control signal line is taken to be Pb3.

The scanning signal lines P1 and P2 connected to pixel circuits in the central row of the panel are taken to be Pc1 and Pc2 respectively and the light emission period control signal line is taken to be Pc3.

When the HI, LOW and HI level signals are input into the scanning signal lines Pa1, Pa2 and Pa3 respectively, information current is written into the upper end row of the panel, thereby storing information in the pixel circuits according to Idata input from the information line.

After that, the LOW, HI and LOW level signals are input into the scanning signal lines Pa1, Pa2 and Pa3 respectively, causing current to flow into the EL element according to the stored information, which causes the EL element to be in a light emitting state.

Thereafter, a HI level signal is input into the scanning signal line Pa3 after a time Ta passed, cutting off current supply to the EL element, which causes the EL element to be in a non-light emitting state.

Therefore, the light emission period in this row is Ta.

Similarly, writing is sequentially performed line by line on a horizontal period basis. An information writing state, light emitting state and non-light emitting state are controlled also in the row between the upper end and the center of the panel.

The light emission period in this row is Tb. Similarly, an information writing state, light emitting state and non-light emitting state are controlled also in the central row of the panel.

The light emission period in this row is Tc.

As illustrated in FIG. 4, the light emission periods Ta, Tb and Tc in the rows are controlled to be Ta<Tb<Tc.

This control brings about an effect that brightness is gradually increased from the upper end to the center of the display portion. Difference in brightness is due to difference in light emission period and does not mean that brightness is instantaneously changed. A visible brightness is determined by the product of an instantaneous brightness and light emission time, so that brightness in this sense is hereinafter referred to as "apparent brightness."

From the center to the lower end row of display portion of the panel, control is carried out which is symmetrical to control in the upper half of the panel, that is to say, control is performed so that the apparent brightness is gradually decreased from the center to the lower end of the display portion.

Figure 11:
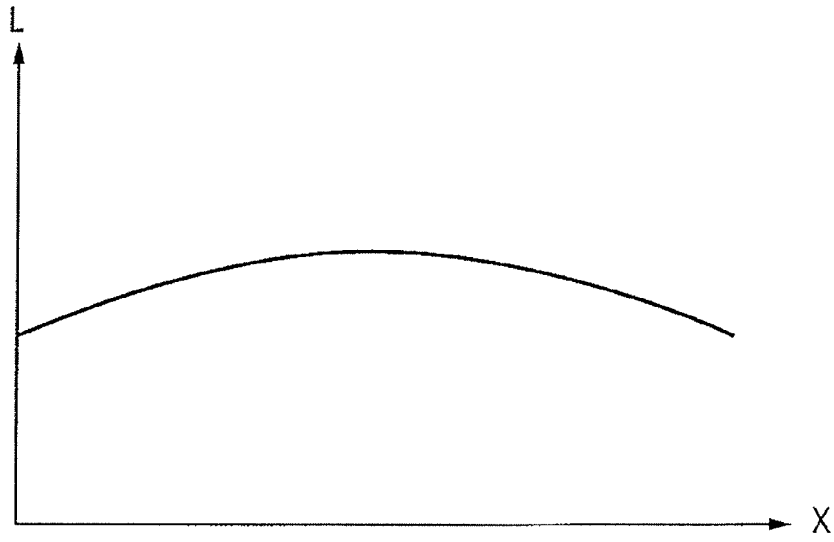
FIG. 11 is a graph illustrating brightness profile in the column direction in the first embodiment.

FIG. 11 is a graph illustrating the profile of the brightness. An X axis shows a vertical scanning direction (or, the position of the row). As illustrated in FIG. 11, the apparent brightness is gradually decreased from the center to the upper and lower ends of the display portion.

Thus, display is performed all over the display portion of the panel, providing an effect that the apparent brightness is gradually decreased from the center to the upper and lower ends of the display portion of the panel.

Figure 13:
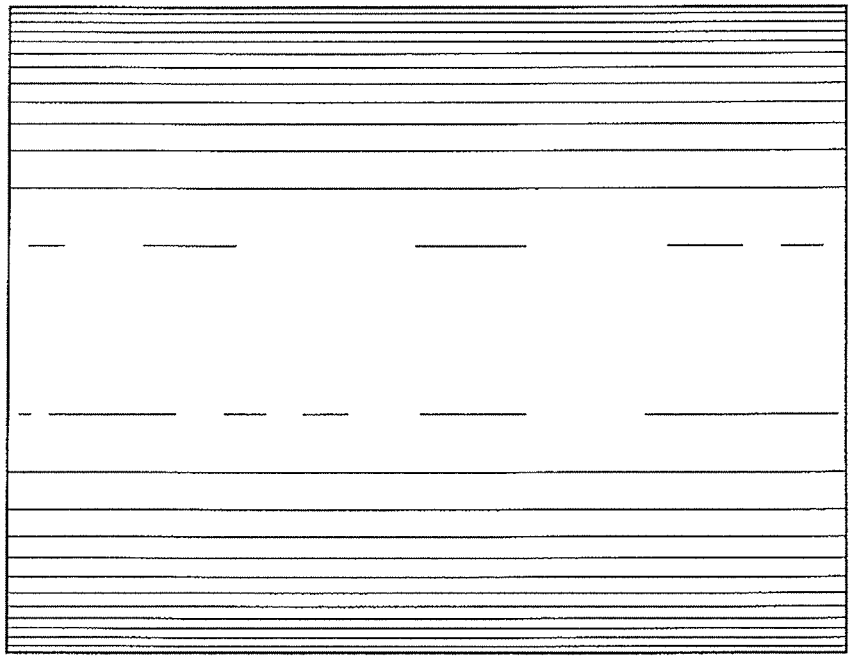
FIG. 13 is a graph illustrating brightness profile in a screen in the first embodiment.

FIG. 13 illustrates, for example, the image data of white color all over the screen (that is, for the case where all pixels emit light by information with the maximum brightness) output by the display apparatus. It is to be understood that the present invention is not limited to the case where all pixels emit light by information with the maximum brightness. It is required only that when data with the same level of brightness is input to the pixel circuits, the display portion may have such a distribution that the central area of the display portion is brighter and the peripheral area thereof is darker.

Figure 12:
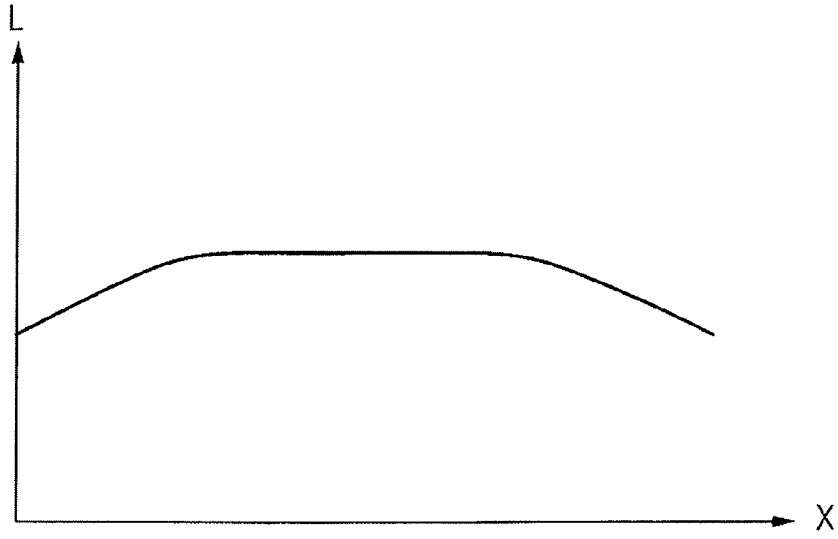
FIG. 12 is a graph illustrating brightness profile in another column direction in the first embodiment.

FIG. 12 is a graph illustrating another example of brightness profile.

In the example of FIG. 11, the brightness has a peak at the center of the display portion. In the example of FIG. 12, on the other hand, the brightness has a plateau in the vicinity of the center. An example of display on the screen of the display apparatus in this case is analogous to one in FIG. 13.

As described above, the light emission period is changed every row to every several rows in the vertical scanning direction by the light emission period control signal line drive circuit 14. This linearly changes the period during which the driving transistor supplies the light emitting element with driving current between the center and the peripheral area so that the period can be longer at the center area and shorter at the peripheral area of the display portion.

Second Embodiment

Figure 5:
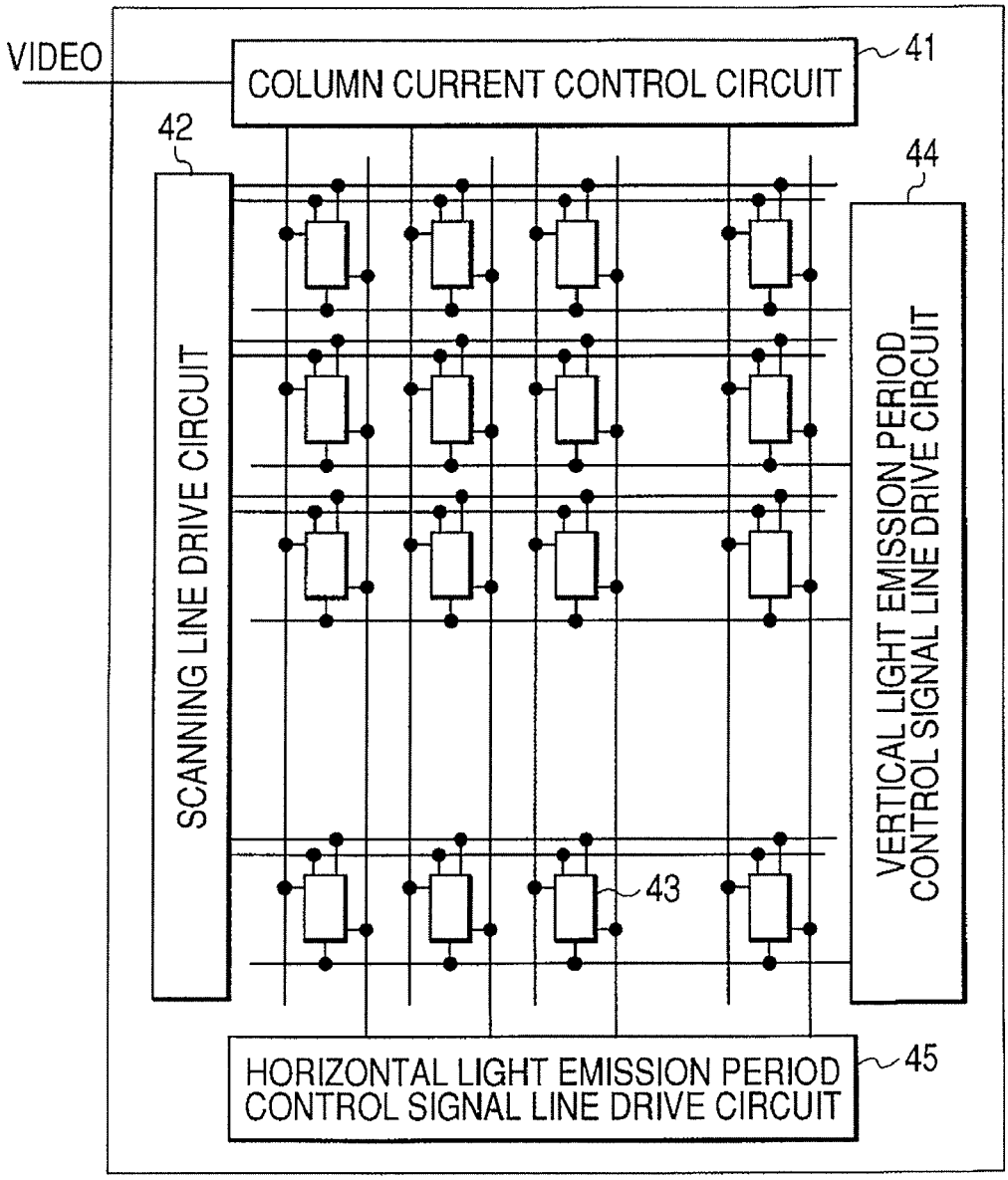
FIG. 5 is a block diagram illustrating the configuration of a second embodiment of the present invention.

FIG. 5 is a block diagram illustrating the configuration of a display apparatus of a second embodiment of the present invention.

The display apparatus of the present embodiment includes a column current control circuit 41, scanning line drive circuit 42, pixel circuit 43, vertical light emission period control signal line drive circuit 44 and horizontal light emission period control signal line drive circuit 45.

The column current control circuit 41 serves to output control current "Idata" to an information line.

The vertical light emission period control signal line drive circuit 44 serves to control a light emission period through the vertical light emission period control signal lines horizontally extending on the display portion. The horizontal light emission period control signal line drive circuit 45 serves to control a light emission period through the horizontal light emission period control signal lines vertically extending on the display portion. The vertical and the horizontal light emission period control signal line drive circuit 44 and 45 function as control units.

The vertical and the horizontal light emission period control signal line drive circuit 44 and 45 are the same in configuration as that in FIG. 2 in the first embodiment.

Figure 6:
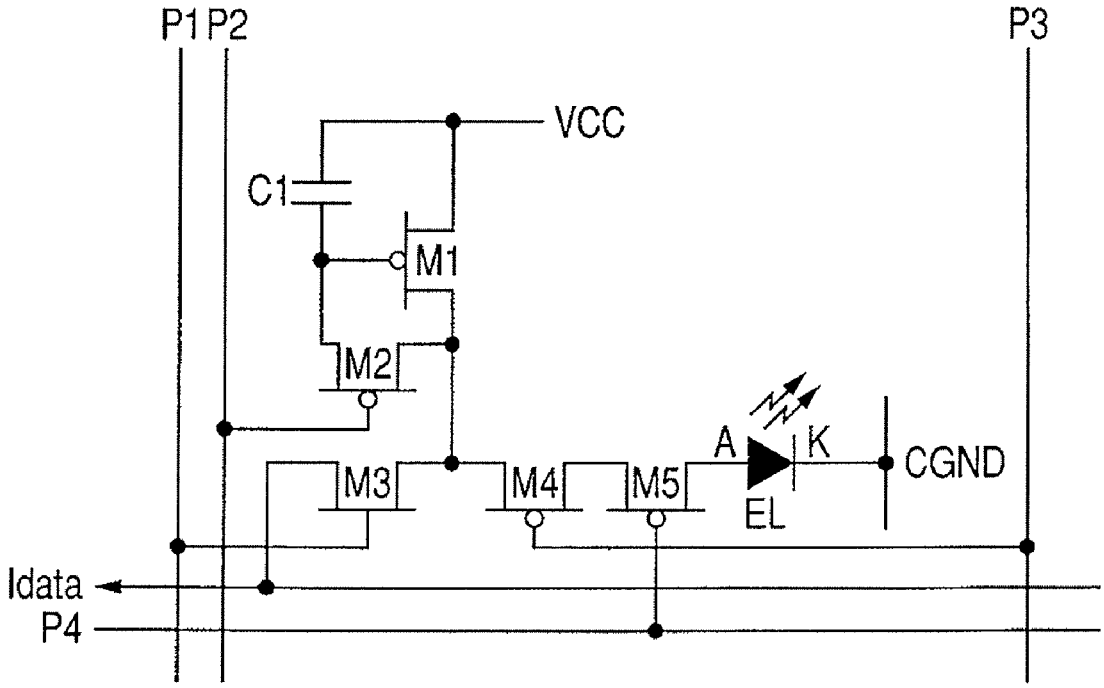
FIG. 6 is a pixel circuit diagram of the second embodiment.

FIG. 6 is a circuit diagram as an example of configuration of a pixel circuit including a light emitting element in the present embodiment.

The pixel circuit includes scanning signal lines P1 and P2, a vertical light emission period control signal line P3 and a horizontal light emission period control signal line P4.

A line into which current data "Idata" is input is referred to as information line.

The anode of an EL element being a light emitting element is connected to the drain terminal of a TFT (M5) and the cathode thereof is connected to a ground potential CGND.

The pixel circuit further includes p-type TFTs M1, M2, M4 and M5 and an n-type TFT M3. The transistor M1 is a driving transistor and the transistors M4 and M5 are switching elements.

The following briefly describes how the pixel circuit operates.

When the Idata is input, a HI level signal is input into the scanning signal line P1, a LOW level signal into the scanning signal line P2 and a HI level signal into the scanning signal lines P3 and P4. The transistors M2 and M3 are turned on and the transistors M4 and M5 are turned off.

At this point, the transistors M4 and M5 are in a non-conductive state, which causes a current not to flow into the EL element.

The current data Idata develops a voltage according to the current driving capability of the transistor M1 across a capacitor C1 arranged between the gate terminal of the transistor M1 and the power source potential V1.

When a current needs to be supplied to the EL element, a LOW level signal is input into the scanning signal line P1, a HI level signal into the scanning signal line P2 and a LOW level signal into the scanning signal lines P3 and P4.

At this point, the transistors M4 and M5 are turned on and the transistors M2 and M3 are turned off. Since the transistors M4 and M5 are in a conductive state, a voltage developed across the capacitor C1 supplies the EL element with a current according to the current driving capability of the transistor M1. This causes the EL element to emit light with brightness according to the supplied current.

When a current flowing into the EL element needs to be cut off, a LOW level signal is input into the scanning signal line P1 and a HI level signal into the scanning signal lines P2, P3 and P4.

At this point, the transistors M2 and M3 are turned off. The transistors M4 and M5 in a non-conductive state cut off current supplied to the EL element and cause the EL element to be in non-light emitting state.

Thus, changing over a level signal from HI to LOW or vice versa on the scanning signal lines P3 and P4 allows arbitrarily controlling a light emitting period.

In the present embodiment, the configuration in FIG. 6 is cited as an example of a pixel circuit, however, it is not limited to this example.

Although a current programming type pixel circuit is cited as an example, a voltage programming type pixel circuit may also be used. The configuration in FIG. 2 disclosed in Japanese Patent Application Laid-Open No. 2004-117648 is cited as an example of the voltage programming type pixel circuit as is the case with the first embodiment.

In the next place, the operation of the entire display apparatus is described. In the present embodiment, a panel with m-rows×n-column picture elements is described.

Figure 7:
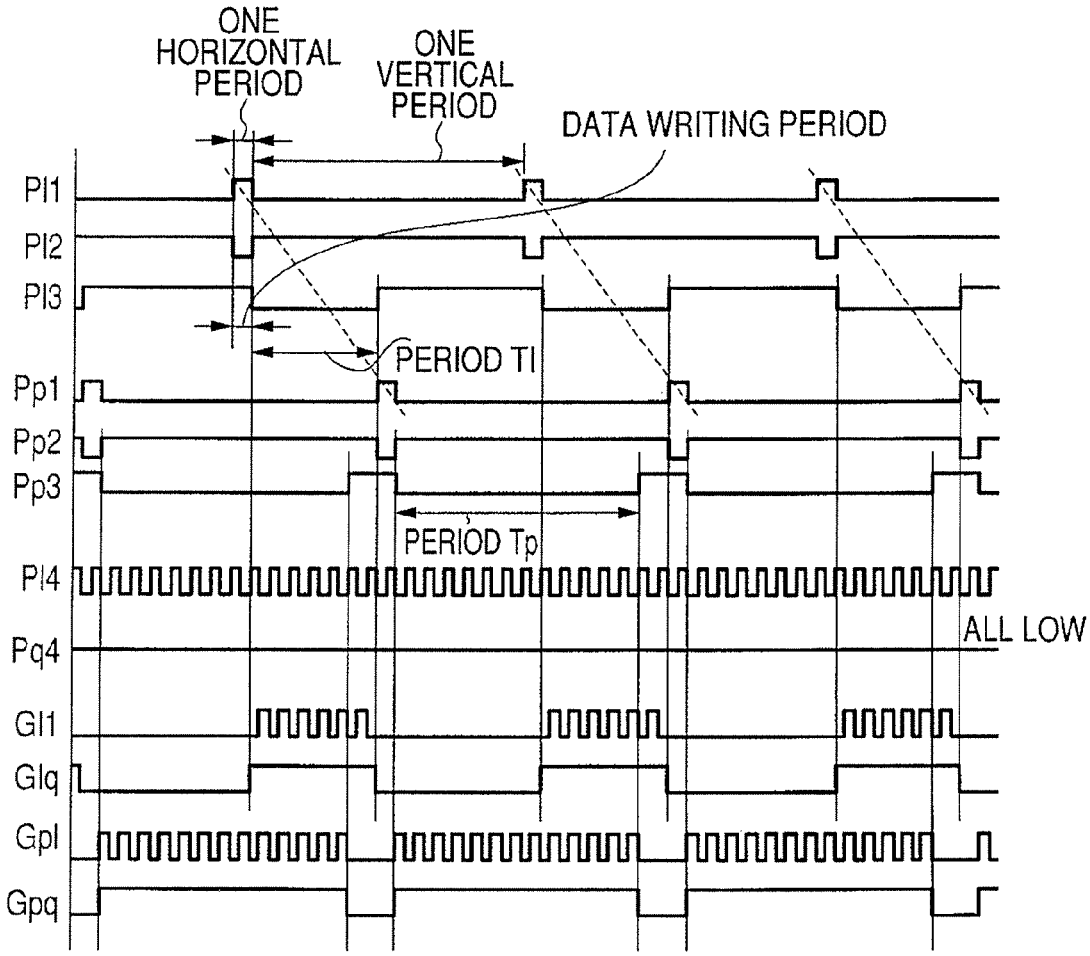
FIG. 7 is a timing chart illustrating the operation of the second embodiment.

FIG. 7 is a timing chart of each signal line.

Information current is collectively written into a pixel group connected to one scanning line during one horizontal scanning period.

Similarly, information current is sequentially and collectively written into a pixel group connected to a scanning line in the next row. Thus, writing information current into all pixels is finished during one vertical period.

Where, the scanning signal lines P1 and P2 connected to pixel circuits in the first row at the upper end of the panel are taken to be P11 and P12 respectively and the vertical light emission period control signal line is taken to be P13.

Similarly, the scanning signal lines P1 and P2 and the vertical light emission period control signal line in the second row are taken to be P21, P22 and P23 respectively.

Sequentially, the scanning signal lines P1 and P2 and the vertical light emission period control signal line in the k-th row of the panel are similarly taken to be Pk1, Pk2 and Pk3 respectively.

The horizontal light emission period control signal line in the I-th row of the panel is taken to be PI4.

The row positioned at the center of the panel is taken to be the p-th row (p=m/2) and the column positioned at the center of the panel is taken to be the q-th column (q=n/2). Where, m is the number of rows and n is the number of columns. Both are an even number.

In FIG. 7, the light emitting states of pixels in the first row and the first column, in the first row and the q-th column, in the p-th row and the first column and in the p-th row and the q-th column are represented by G11, G1*q*, Gp1 and Gpq respectively.

In the first embodiment, the vertical light emission period control signal line is controlled to control an apparent brightness distribution on a row basis. In the present embodiment, in addition to the above, the horizontal light emission period control signal line is controlled to control an apparent brightness distribution also on a column basis.

As is the case with the first embodiment, the vertical light emission period control signal lines perform such a control that a light emission time is increased from the first row to the p-th row and decreased from the (p+1)-th row to the m-th row so that an apparent brightness reaches a maximum at the central row.

The horizontal light emission period control signal lines perform such a control that a light emission time is increased from the first column to the q-th column and decreased from the (q+1)-th column to the n-th column so that an apparent brightness reaches a maximum at the central column.

The horizontal light emission period control signal is formed of pulses which switch between the HI and LOW levels at a period equal to or shorter than one horizontal scanning period. The duty ratio of the LOW period within this period is changed in accordance with a column. The duty ratio in the first column is minimized or the LOW period is shortened. Then, the duty ratio is gradually increased as the column number is increased to the second, the third, . . . , and in the q-th column (or in the central column) the duty ratio of the pulse becomes one (1) or a LOW signal in the whole period. The duty ratio starts decreasing from the (q+1)-th column and is equal to the duty ratio of the first column in the n-th column.

In other words, if the duty ratio of the LOW period of the horizontal light emission period control signal line 14 in the I-th column is taken to be KI, the duty ratio KI is controlled so that K1<K2< . . . <Kq>Kq+1> . . . >Kn.

Thus, the light emission period determined in the LOW period of both P3 and P4 is determined by the ratio of the LOW period of the horizontal light emission period control signal line to the LOW period of the vertical light emission period control signal line.

Reference character G11 denotes the light emission period of a pixel in the first row and first column in FIG. 7. Light is emitted in a period (T1) during which the switch M4 is closed by the vertical light emission period control in the first row in a period during which the switch M5 is closed by the horizontal light emission period control in the first column, that is to say, light is emitted in the period of duty ratio K1 in the first column. Reference character G1*q* represents the light emission period of a pixel in the first row and the q-th column. Light is emitted in a period during which a duty ratio in the T1 period is one (1), that is, light is emitted in the whole period of T1.

Reference character Gp1 indicates the light emission period of a pixel in the p-th row and the first column. Light is emitted in a period of duty ratio of K1=1 in a period Tp during which the switch M4 is closed by the vertical control in the p-th row.

Reference character Gpq signifies the light emission period of a pixel in the p-th row and the q-th column. Light is emitted in the whole period of Tp.

Among the four pixels, a pixel in Gpq is the higher in brightness, pixels in G1*p* and Gp1 are lower than the former and a pixel during G11 is the lowest. The brightness profile of the screen in the vertical and the horizontal direction is illustrated in FIG. 14.

Thus, display is performed all over the display portion of the panel, providing an effect that the apparent brightness is gradually decreased from the center to the upper and the lower end of the display portion of the panel.

In addition to the above, an effect can be obtained that the apparent brightness is gradually decreased from the center to the left and the right end of the display portion of the panel.

Figure 14:
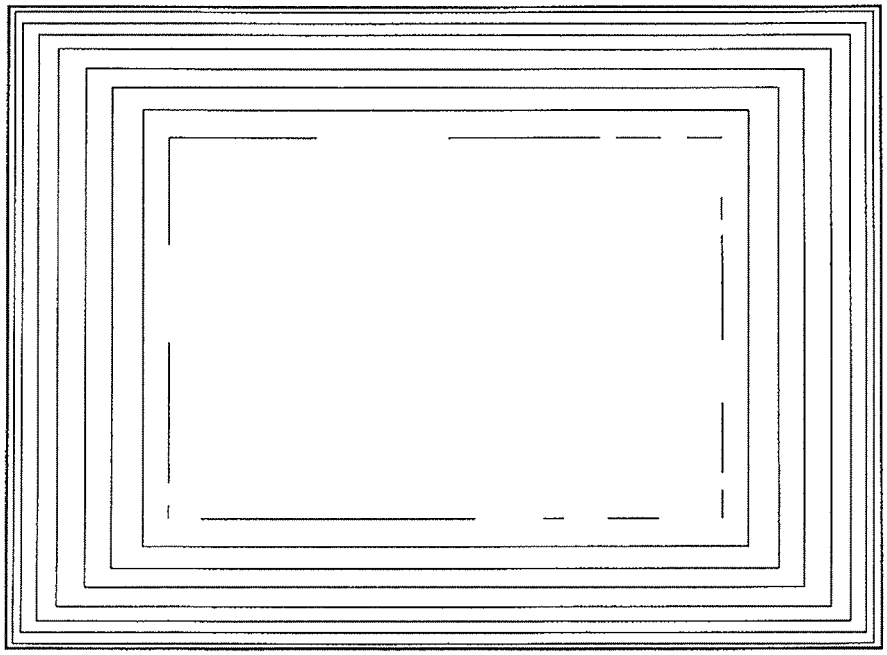
FIG. 14 a graph illustrating brightness profile in a screen in the second embodiment.
Figure 15:
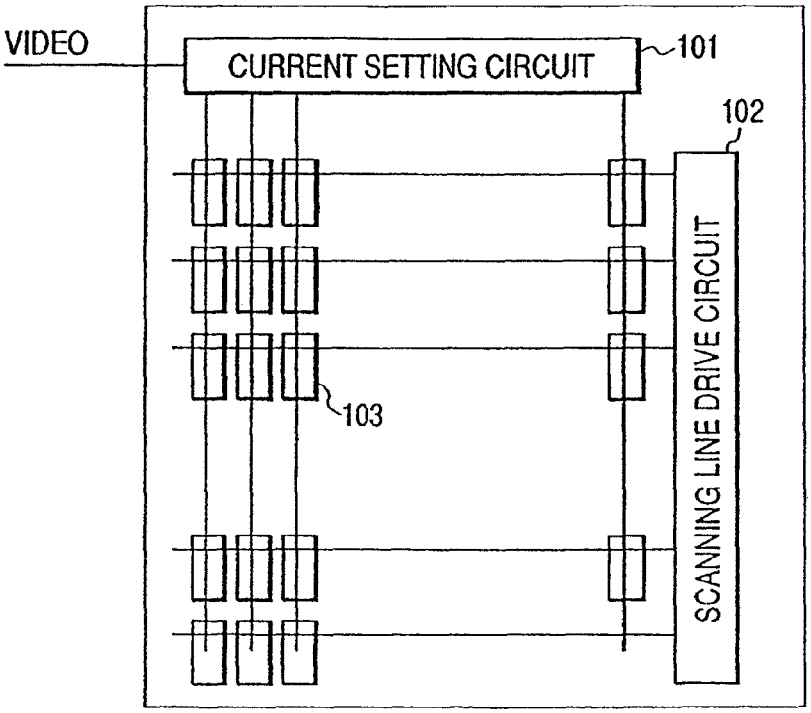
PRIOR ART FIG. 15
FIG. 15 is a block diagram illustrating the configuration of an active matrix display apparatus in related art.
Figure 16:
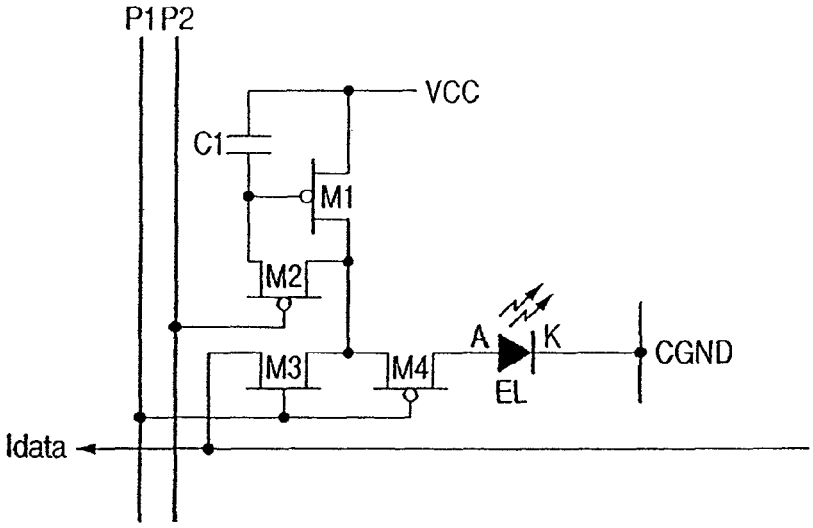
FIG. 16 PRIOR ART
FIG. 16 is a circuit diagram as an example of configuration of a pixel circuit including an EL element of related art.

FIG. 14 illustrates, for example, the image data of white color all over the screen (that is, for the case where all pixels emit light by information of the maximum brightness) output by the display apparatus. It is to be understood that the present invention is not limited to the case where all pixels emit light based on information of the maximum brightness. It is required only that when information of the same level of brightness is input to the pixel circuits, the display portion may have such a distribution that the central area of the display portion is brighter and the peripheral area thereof is darker.

As described above, the light emission period is changed every row to every several rows in the vertical scanning direction and every column to every several columns in the horizontal scanning direction by the light emission period control signal line drive circuits 44 and 45. This changes two-dimensionally the period during which the driving transistor supplies the light emitting element with driving current between the center and the peripheral area so that the period is longer at the center area and shorter at the peripheral area of the display portion.

Third Embodiment

In the first and the second embodiment, the apparent brightness is improved by controlling the light emission period so as to have distribution on a screen, at the center on the screen of the display apparatus having pixel circuits in which gradation is performed by light emission intensity.

In the present embodiment, the apparent brightness at the center on the screen is improved by controlling the display apparatus having pixel circuits in which gradation is attained by controlling a light emission period so that the light emission intensity has distribution on the screen.

Figure 8:
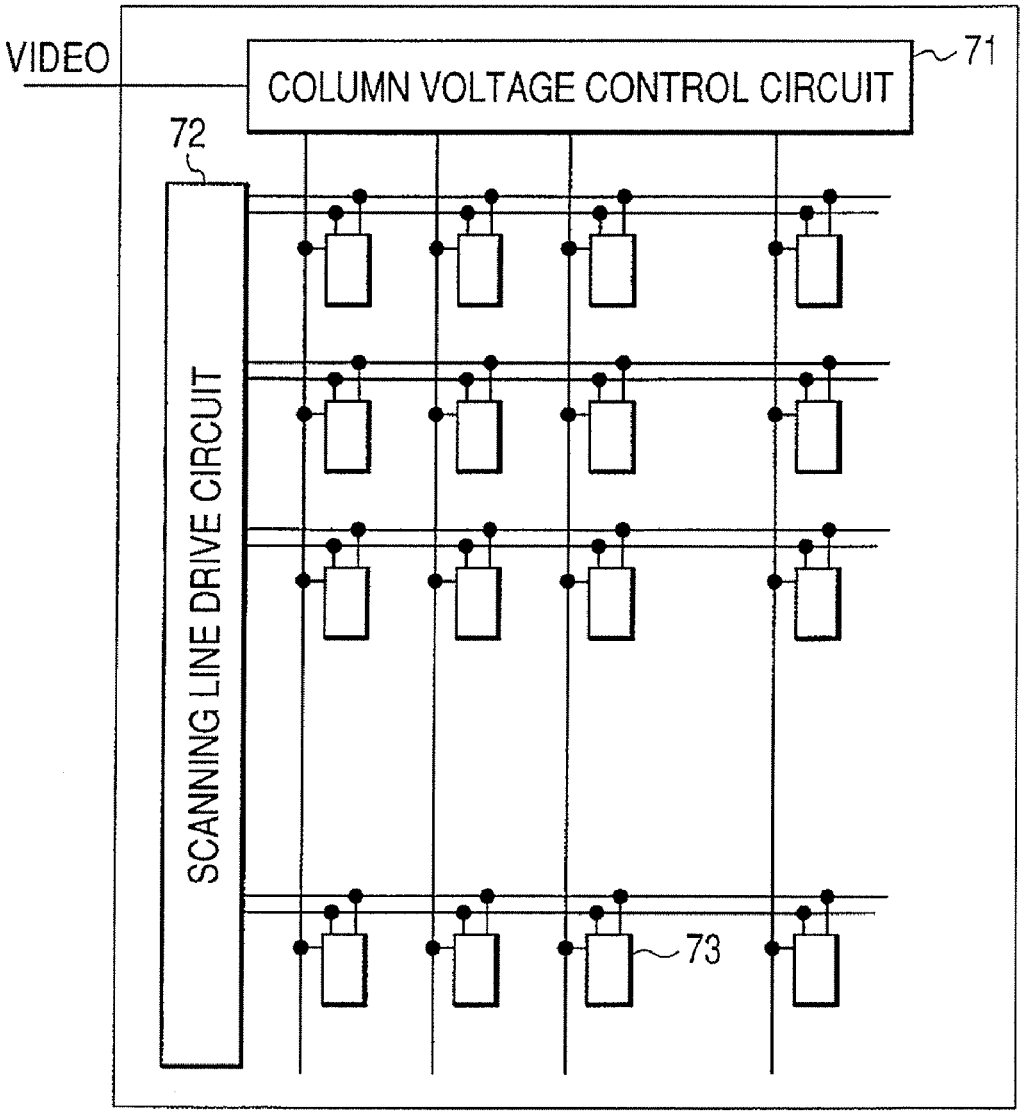
FIG. 8 is a block diagram illustrating the configuration of a third embodiment of the present invention.

FIG. 8 is a block diagram illustrating the configuration of a display apparatus in a third embodiment of the present invention. The display apparatus of the present embodiment includes a column voltage control circuit 71, scanning line drive circuit 72 and pixel circuit 73.

The column voltage control circuit 71 serves to output a control voltage "Vdata" to an information line.

Figure 9:
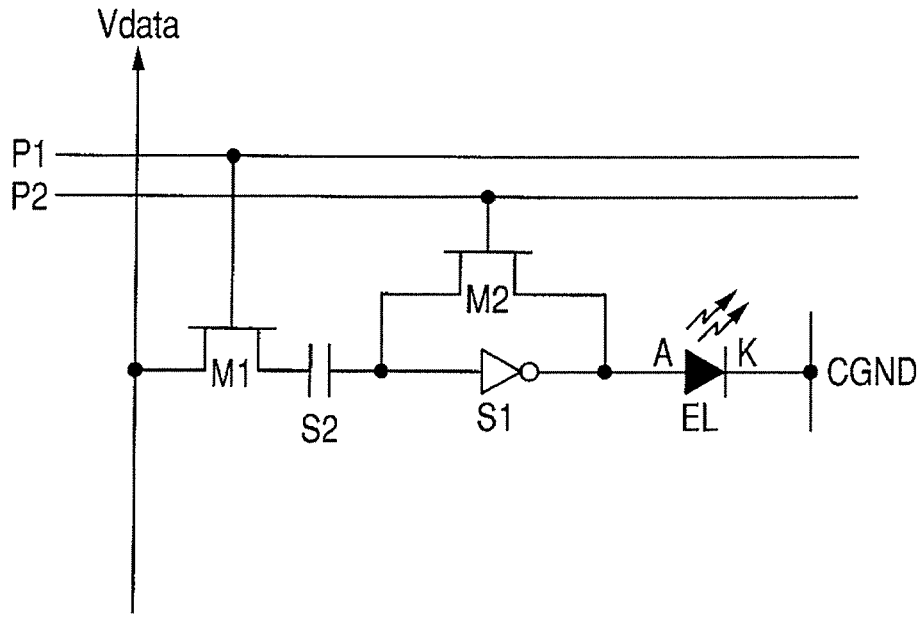
FIG. 9 is a pixel circuit diagram of the third embodiment.

FIG. 9 is a circuit diagram as an example of configuration of a pixel circuit including a light emitting element in the present embodiment.

The pixel circuit includes scanning signal lines P1 and P2.

The voltage Vdata being an information signal is input into the information line.

The anode of an EL element being a light emitting element is connected to the output stage of an inverter circuit 81 and the cathode of the EL element is connected to a ground potential CGND. The detailed configuration of the inverter circuit 81 is not illustrated. As is well-known, the inverter circuit 81 has a driving transistor for causing current to flow from a power supply VCC to the EL element. The gate of the driving transistor is connected to a capacitor S2.

The information line for the voltage Vdata is connected to the storage capacitor S2 through an input TFT (M1). The other end of the storage capacitor S2 is connected to one end of a resetting TFT (M2) and the input stage of the inverter circuit 81.

The following briefly describes how the pixel circuit 73 operates.

In the pixel circuit 73, writing information into all pixels is performed during the first half of one horizontal scanning period and performing display operation of all pixels during the second half of one horizontal scanning period.

First, writing operation is described.

The scanning signal line P2 rises to cause the resetting TFT (M2) to be in a conductive state, resetting the input and output voltage of the inverter circuit 81 to "Vrset." This voltage is applied to one end of the storage capacitor S2.

At this point, when the scanning signal line P1 rises to cause the input TFT (M1) to be in a conductive state, the voltage Vdata input into the signal line is applied to the other end of the storage capacitor S2.

After that, the scanning signal line P2 falls to cause the resetting TFT (M2) to be in a non-conductive state.

The above operation means that required signal potentials are written into the storage capacitors S2 of pixels in the selected row so that the above display signal voltage is input from the signal line, the voltage Vrst is input into the input of the inverter circuit 81.

If the rising characteristic of the inverter circuit 81 is sufficiently sharp, the voltage Vrst becomes almost equal to an on-voltage "Von" of the inverter circuit 81, which may be regarded as approximately the same voltage.

That is to say, in the pixel, the signal voltage Vdata is input from the signal line, and then this substantially equalize the output of the inverter circuit 81 to the on-voltage Von to cause current to flow into the EL element.

Next, display operation is described.

The scanning signal line P1 of all pixels rise to cause input TFTs (M1) of all pixels to be in a conductive state.

A driving voltage having a triangle waveform is applied to each signal line during this period.

At this point, the input TFT (M1) is turned on, so that the pixel driving voltage is input into the storage capacitors S2 of all pixels.

In the pixels in which the pixel driving voltage having a triangle waveform coincides with the signal voltage already stored during the writing period, the input voltage of the inverter circuit 81 becomes equal to the voltage Vrst (=Von), causing the EL element to emit light.

Thus, in the present embodiment, modulating the light emission time of each pixel on the basis of the display signal voltage written in advance enables pixels to perform multi-gradation light emission display.

In the present embodiment, the driving voltage having a triangle waveform input into the information line is modulated on an information line basis.

Figure 10:
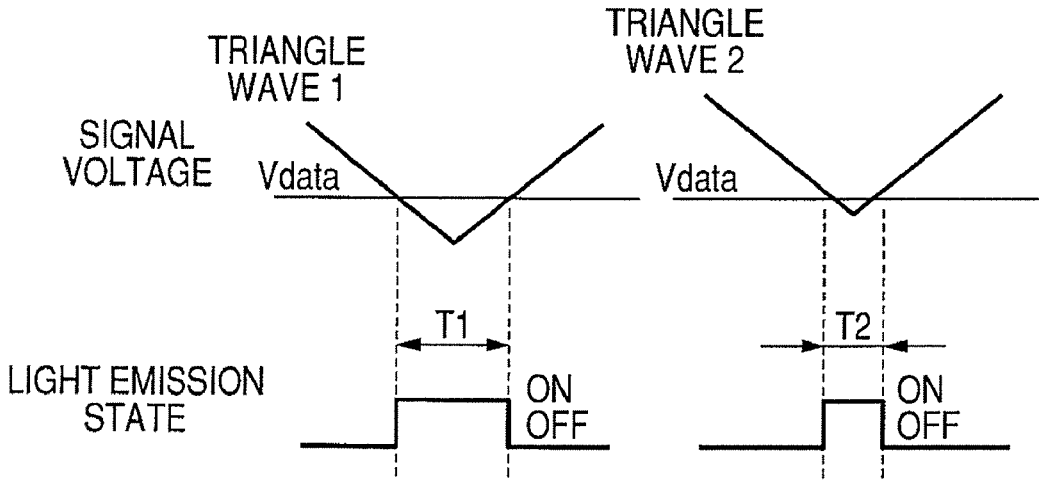
FIG. 10 is a chart illustrating relationship between signal voltage and light emitting state in the third embodiment.

The example of the above is illustrated in FIG. 10.

A triangle wave 1 is input into the information lines in the center of the screen and a triangle wave 2 higher in voltage than the triangle wave 1 is input into the information lines in the periphery of the screen.

The above effect causes the pixel following the triangle wave 2 to emit light later in timing of start of light emission and earlier in timing of extinction than the pixel following the triangle wave 1 when the same information signal Vdata is input.

For this reason, the pixels connected to the information lines in the periphery of the screen are shorter in light emission period than those in the information lines in the center of the screen.

Thus, display is performed all over the display portion of the panel, providing an effect that the apparent brightness is gradually decreased from the center to the left and the right end of the panel.

In the present embodiment, the column voltage control circuit 71 serves also as a light emission period control signal line drive circuit. This control circuit changes the light emission period every column to every several columns in the horizontal scanning direction. This linearly changes the period during which the driving transistor supplies the light emitting element with driving current between the center and the peripheral area so that the period is longer at the center area and shorter at the peripheral area.

It is to be understood that the present invention is not limited to the case where all pixels emit light by information with the maximum brightness. When data with the same level of brightness is input to the pixel circuits, the display portion may have such a distribution that the central area of the display portion is brighter and the peripheral area thereof is darker.

Although the EL display apparatus using an EL element is described as an example in the above embodiments, the present invention is not limited to the embodiments, but may be applied to an apparatus in which light is emitted by a current signal. For example, it is a light emitting diode of inorganic material.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2006-181671, filed Jun. 30, 2006, which is hereby incorporated by reference herein in its entirety.

What is claimed is:

1. An active matrix type display apparatus comprising pixel circuits arranged in the row and column directions to form a display portion, the pixel circuit including a capacitor which holds an electric signal representing information, a driving transistor, a control terminal of which is connected to one end of the capacitor and which outputs driving current according to information held in the capacitor, a light emitting element which emits light with brightness according to current output from the driving transistor, and a switching element which opens and closes a current path from the driving transistor to the light emitting element, wherein a time period during which the switching element closes the current path is set to be gradually shortened from the center area to the peripheral area of the display portion.

2. The active matrix type display apparatus according to claim 1, wherein the switching elements of the pixel circuits in a row or a column are connected to a common control signal line in the row or the column direction, respectively, so as to be opened and closed simultaneously.

3. The active matrix type display apparatus according to claim 1, wherein the switching element is connected between the driving transistor and the light emitting element and connected to a common control signal line in the row direction and controlled so that the conductive period of the switching elements of the pixel circuits in the central row is longer than the conductive period of the switching elements of the pixel circuits in the upper and the lower side rows.

4. The active matrix type display apparatus according to claim 1, wherein the pixel circuit includes two switching elements which are connected to each other in series, one of the two switching elements is connected to a common control signal line in the row direction and the other of the two switching elements is connected to a common control signal line in the column direction.

5. The active matrix type display apparatus according to claim 4, wherein the conductive period of the switching elements connected to a common control signal line in the row direction is controlled on a row basis in one vertical period and the conductive period of the switching elements connected to the common control signal line in the column direction is controlled on a column basis in one horizontal period or shorter.

6. The active matrix type display apparatus according to claim 5, wherein the two switching elements are controlled so that the conductive period of the one switching element connected to the control signal line of the central row is longer than the conductive period of the one switching element connected to the control signal line of the upper and the lower side rows, and the conductive period of the other switching element connected to the control signal line of the central column is longer than the conductive period of the other switching element connected to the control signal line of the left and the right side columns.

* * * * *